US011001771B2

(12) United States Patent
Sarkar et al.

(10) Patent No.: US 11,001,771 B2
(45) Date of Patent: May 11, 2021

(54) PROCESS FOR THE PRODUCTION OF PETROCHEMICAL FEEDSTOCK AND HIGH OCTANE GASOLINE FROM MIDDLE DISTILLATES

(71) Applicant: Indian Oil Corporation Limited, Mumbai (IN)

(72) Inventors: Mainak Sarkar, Faridabad (IN); Nayan Das, Faridabad (IN); Ganesh Vitthalrao Butley, Faridabad (IN); Sandeep Kumar, Faridabad (IN); Ram Mohan Thakur, Faridabad (IN); Ramesh Karumanchi, Faridabad (IN); Sarvesh Kumar, Faridabad (IN); Madhusudan Sau, Faridabad (IN); Sanjiv Kumar Mazumdar, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 16/850,822

(22) Filed: Apr. 16, 2020

(65) Prior Publication Data

US 2020/0377807 A1 Dec. 3, 2020

(30) Foreign Application Priority Data

May 27, 2019 (IN) ..... 201921020972

(51) Int. Cl.

*C10G 69/04* (2006.01)
*C10G 65/12* (2006.01)
*C10G 7/00* (2006.01)
*C10G 11/18* (2006.01)

(52) U.S. Cl.

CPC ..... *C10G 69/04* (2013.01); *C10G 7/00* (2013.01); *C10G 11/18* (2013.01); *C10G 65/12* (2013.01); *C10G 2300/1048* (2013.01); *C10G 2300/202* (2013.01); *C10G 2300/305* (2013.01); *C10G 2300/307* (2013.01); *C10G 2300/308* (2013.01); *C10G 2300/4025* (2013.01); *C10G 2400/02* (2013.01); *C10G 2400/30* (2013.01)

(58) Field of Classification Search

USPC ..... 208/57, 68, 67; 585/319, 404, 410
See application file for complete search history.

(56) References Cited

U.S. PATENT DOCUMENTS 4,990,239 A * 2/1991 Derr, Jr. ..... C10G 47/00 208/111.15
6,837,989 B2 * 1/2005 Stuntz ..... C10G 69/04 208/74

(Continued)

FOREIGN PATENT DOCUMENTS

WO 2017146876 8/2017

*Primary Examiner* — Nina Bhat
(74) *Attorney, Agent, or Firm* — Workman Nydegger

(57) ABSTRACT

A process for upgrading light cycle oil (LCO) to a high octane gasoline and a high aromatic feedstock for aromatic complex, by utilizing fluid catalytic cracking (FCC) is disclosed. FCC cracks unconverted diesel range stream from a hydrocracker to a high octane gasoline. This process further improves the quality (e.g., research octane number (RON), and Sulfur) of gasoline by utilizing FCC and hydrocracking process.

13 Claims, 2 Drawing Sheets

(56) References Cited

U.S. PATENT DOCUMENTS

| | | | | |
|---|---|---|---|---|
| 7,368,619 | B1 * | 5/2008 | Frey | C07C 6/126 208/108 |
| 7,384,542 | B1 * | 6/2008 | Thakkar | C10G 65/14 208/107 |
| 8,066,867 | B2 * | 11/2011 | Dziabala | C10G 65/12 208/57 |
| 8,702,971 | B2 * | 4/2014 | Jan | C10G 29/205 208/133 |
| 9,644,155 | B2 * | 5/2017 | Butley | C10L 1/026 |
| 10,822,557 | B2 * | 11/2020 | Sarkar | C10G 9/00 |
| 2012/0205285 | A1 * | 8/2012 | Dindi | C10G 65/12 208/49 |
| 2018/0171246 | A1 | 6/2018 | Pupat et al. | |
| 2019/0337869 | A1 * | 11/2019 | Erisken | C10G 69/00 |
| 2020/0181509 | A1 * | 6/2020 | Brown | C10G 47/00 |
| 2020/0239791 | A1 * | 7/2020 | Xu | C10G 69/00 |

* cited by examiner

PROCESS FOR THE PRODUCTION OF PETROCHEMICAL FEEDSTOCK AND HIGH OCTANE GASOLINE FROM MIDDLE DISTILLATES

FIELD OF THE INVENTION

The present invention relates to an integrated process for the production of high octane gasoline and aromatic rich naphtha feedstock for BTX complex from Light Cycle Oil (LCO).

BACKGROUND OF THE INVENTION

Light Cycle Oil (LCO) is a middle distillate stream from Fluid Catalytic Cracking Unit (FCC) or Resid Fluid Catalytic Cracking Unit (RFCC). Typically, 10-30 wt % yield of LCO is obtained on fresh feed basis from an FCC Unit. It is an aromatic rich stream and aromatic content in LCO varies from 60 wt % to 90 wt % depending upon operational severity and type of feedstock. Out of the total aromatics in LCO stream, 20-30 wt % is mono-aromatics, 60-70 wt % is di-aromatics and 10-20 wt % is poly-aromatics type of compound (PAH). Due to high aromatic content, the Cetane number of LCO is very poor (CN<25). Presently, LCO is processed in a Diesel Hydro-treating Unit (DHDT) and blended in the refinery diesel pool. In high pressure hydrotreater (90-120 bar), Cetane of LCO stream improves 15-25 units through saturation of aromatics to naphthenes. However, the Cetane number of hydrotreated LCO does not go beyond 40-42 range. Also, hydro-treated LCO fails to meet the specific gravity criteria of EURO-VI diesel (0.87-0.91 against 0.845). Therefore, hydrotreatment of LCO at very high pressure and converting the aromatics to naphthenes without meeting CN specification is inefficient utilization of costly hydrogen.

Other available option for adding value to this stream is to convert LCO into feedstock for aromatic complex for the production of aromatic (e.g., benzene, toluene and xylene). Being an aromatic rich stream, the chemical potential lies in its high aromaticity. The di- and tri-aromatics present in this stream can be converted into mono-aromatics through mild hydrocracking route. This route comprises of two steps. Hydro-treating of LCO is being carried out in the first step and in the second step, hydrotreated stream subjected to hydrocracking. Both the operations are carried out at moderate hydrogen pressure (25-75 bar g). Such pressure protects mono-aromatic molecules from oversaturation and maximizes the Alkyl benzene concentration in the product stream. The unconverted stream has a boiling range same as diesel and contains naphthobenzene types of molecules. This stream is low in Cetane number high in density compared to Euro-VI diesel pool. Therefore, further treatment is required for accommodating in BS/EURO-VI diesel pool.

High aromatic content in the middle distillate streams of any thermal or catalytic cracker unit is the major hurdle to incorporate these streams into the refinery diesel pool. On hydrotreating these streams, the multi ring aromatics get converted to mono-aromatics but with fused naphthenic ring (i.e. naphtho benzene). The saturation of first ring or second ring occurs at very low hydrogen partial pressure; however, saturation of last aromatic rings requires very high hydrogen partial pressure. Even after saturating all the aromatic rings, the CN improvement is very insignificant compared to the hydrogen consumption. Therefore, efforts are being made for profitable utilization of these types of streams.

US2018171246A1 discloses an installation for the hydro-treatment and hydro-conversion of hydrocarbon-containing feedstocks, with a common fractionation section, for the production of at least one of the following products: naphtha (light and/or heavy), diesel, kerosene, distillate and residue.

WO2017146876A1 discloses an integrated process for increasing olefin production through which heavy cracker residues of fluid catalytic cracking unit and steam cracking unit are completely mixed, and mixed stream is properly recycled and further combined with atmospheric tower bottoms. Combined stream is deasphalted and hydro-treated to produce a proper feedstock for steam cracking unit for manufacturing light olefin compounds.

OBJECTIVES OF THE INVENTION

Primary objective of the present invention is to provide a process for the production of high octane gasoline and high aromatic naphtha, feedstock for aromatic complex for production of petrochemicals viz. Benzene, Toluene and Xylene.

The further objective of this invention is to recycle back the unconverted generated in the LCO Mild hydrocracking process to the FCC unit for further conversion of naphtha benzenes to di- and tri-aromatics.

Another objective of the present invention is to provide the process to improve the quality (e.g., RON, Sulfur) of gasoline by utilizing FCC and hydrocracking processes.

Further objective of the present invention is to provide the process for the production of high aromatic naphtha and high octane gasoline from FCC and hydrocracking integration.

It is further objective of the present invention to control and provide optimized operating conditions for maximizing conversion of UCO in FCC.

SUMMARY OF THE INVENTION

Accordingly, the present invention provides a process for production of high octane gasoline and high aromatic feedstock, the process comprising:

(a) subjecting a light cycle oil (LCO) feed is having a boiling range of 180 to 410° C. to a hydro-treatment step in a first reactor to obtain a hydrotreated stream having removed heteroatom and selectively saturates one or two ring of multi-ring aromatics molecules and to remains unsaturated at least one ring of the multi-ring aromatics present in the feed, wherein the multi-ring aromatics molecules comprises di-aromatics and tri-aromatics;

(b) subjecting the hydrotreated stream to a hydrocracking step in a second reactor filled with a catalyst for selectively opening a naphthenic ring attached to the aromatic ring present in the hydrotreated stream;

(c) fractionating the hydrocracked stream into a three cuts, wherein:

(i) first cut is a light naphtha and having a boiling range of initial boiling point (IBP) to 95° C., (ii) second cut or Heart cut is the high aromatic feedstock having aromatic content is in the range of 50 and 80 wt % and boiling range of 95 to 210° C., wherein second cut is rich in alkyl benzene, and (iii) third cut is an unconverted oil (UCO) and having IBP more than 210° C. wherein the UCO is rich in tetrahydronaphthalene (Tetralin) or substituted tetrahydronaphthalene (tetralin), (d) cracking the third cut comprising the UCO in a fluid catalytic cracking (FCC) unit, wherein the UCO is blended with fresh feed and fed into the FCC unit to produce a set of products comprising of ethylene, propylene, naphtha range stream called light cracked naphtha (LCN), heavy cracked naphtha (HCN) and other distillates comprising LCO, and clarified oil (CLO); and (e) the LCO is generated in FCC step is fed back to the step (a).

In one of the preferred features, the Light Cycle Oil (LCO) is having boiling point in the range of 200-380° C.

In another preferred feature, the first cut (light naphtha) is having boiling range of IBP-80° C. Preferably the boiling range of the first cut is IBP-65° C.

In another feature of the present invention, the high aromatic feedstock is having boiling range of 65-200° C. Preferably the boiling range of the high aromatic feedstock is 65-180° C.

In one of the features of the present invention, the operating condition of the second reactor is a mild operating condition.

In another feature of the present invention, the UCO is rich in tetrahydronaphthalene (Tetralin) or substituted tetralin types of molecules along with other paraffin, iso-paraffin and naphthenic types of molecules.

In one of the feature of the present invention, the first cut is a Light Naphtha (LN) refers to a hydrocarbon stream having boiling range of C5 or IBP to 95° C. Preferably the boiling range of the first cut is between C5 and 75° C. More preferably the boiling range of the first cut is between C5 and 65° C. The first cut (Light Naphtha) is called as 'high octane gasoline'. The Research Octane number (RON) of the stream is between 80 and 95 units. Preferably, the RON is between 85 and 92 units. More preferably the RON is between 88 and 91 units. This stream can be blended directly into the gasoline pool.

In another feature of the present invention, the second cut is a High aromatic naphtha feedstock or 'heart cut' refers to the naphtha stream generated from hydrocracker fractionator is having a boiling range between 95 and 210° C. Preferably the boiling range is between 85 and 200° C. More preferably the boiling range is between 65 and 180° C. The aromatic content of this stream is between 50 and 80 wt %. Preferably the aromatic content of this stream is between 60 and 75 wt %. This stream can be used in the aromatic complex as a feedstock. In case aromatic complex is not present in the refinery configuration, this stream can be used as blending stream for gasoline pool.

In yet another feature of the present invention, the third cut is an Unconverted Oil (UCO) having an initial boiling point (IBP) more than 210° C., preferably having the IBP more than 200° C., and more preferably having IBP more than 180° C.

In one feature of the present invention, the UCO comprises 15-20 wt % of cyclo-paraffin, at least 15-20 wt % of alkyl benzene and 25-30 wt % of benzo cycloparaffin.

In one of the features of the present invention, the FCC operating conditions are controlled to maximize the yields from UCOs of low severity as well as high severity hydrocracking, wherein:

a fraction of UCO converted to LCO and CLO contains more sulphur compared to feed UCO, however lower than the LCO and CLO generated from 'fresh feed'.

In another feature of the present invention, the LCO generated in FCC unit is having 10 wt % more aromatic compared to that generated from fresh feed.

In yet another feature of the present invention, the LCO generated in FCC unit is having 10 wt % more aromatic, in which di-aromatic is at least 80 wt %.

In yet another feature of the present invention, the LCO generated in FCC unit having 10 wt % more aromatic, in which di-aromatic is at least 80 wt %, increases Alkylbenzene concentration in the second cut by 5 wt %.

In another feature of the invention, the light naphtha (first cut) generated in LCO hydrocracking process contains sulphur preferably less than 5 wt ppm and most preferably below 1 wt ppm when blended with FCC gasoline, reduce the sulphur without much disturbing the overall RON. The overall RON of the gasoline from this process complex is preferably between 90 and 94 unit and most preferably between 91-93 units.

In yet another feature of the invention, two product routing option has been conceptualized. Option-I: In this scenario, aromatic complex is present in the refinery. The Light Naphtha (high octane gasoline) stream is routed towards Gasoline pool owing to the fact that LN has high RON (~87) and low in Sulphur (i.e., <0.5 ppmw). The high aromatic naphtha feedstock is therefore used as a feedstock to the aromatic complex.

Option-II: In this scenario, aromatic complex is not present and the Cut-1 and Cut-2 both are routed to refinery gasoline pool, owing to the fact that total naphtha (Cut-1 & Cut-2) has RON (~95) and low in Sulphur (i.e., <0.5 ppmw).

In yet another feature of the invention, the UCO stream recycled back into the FCC unit and cracked further to produce Gasoline, wherein this gasoline has low sulfur content than the gasoline produced by 100% fresh feed processing.

In yet another feature of the invention, in the FCC unit a light alkene is produced by cracking of alkyl chain attached with the substituted tetrahydronaphthalene present in the UCO stream.

In one feature of the present invention, the hydro-treating reactor has been used to remove metals, heteroatoms (i.e., sulphur and nitrogen) and to saturate single aromatic ring of di-aromatics, tri-aromatics and PAH molecules. Nitrogen compounds have detrimental effect on hydrocracking catalyst and therefore must be maintained below 50 ppmw, more preferably below 30 ppm and most preferably below 20 ppm.

In another feature of the present invention, the hydro-treatment step is operated at a temperature in the range of 310 to 420° C. Preferably the hydro-treatment step is operated at a temperature in the range of 340 to 410° C. More preferably the hydro-treatment step is operated at a temperature in the range of 350 to 390° C.

In yet another feature of the present invention, the hydro-treatment step is operated at a pressure in the range of 25 to 100 bar g. Preferably the hydro-treatment step is operated at a pressure in the range of 40 to 80 bar g. More preferably the hydro-treatment step is operated at a pressure in the range of 50 to 75 bar g.

In yet another feature of the present invention, in the hydro-treatment step a Linear hourly Space Velocity (LHSV) is maintained in the range of 0.5 to 1.5. Preferably the LHSV is maintained between 0.67 and 1.2.

In yet another feature of the present invention, in the hydrocracking reactor, the effluent from hydro-treating reactor is cracked and produces mono-aromatic, more specifically alkyl benzenes. In the conversion process, the saturated ring attached to benzene or naphthalene ring gets open producing alkyl benzene or alkyl substituted tetrahydronaphthalene. The molecules produced in this reactor has preferable boiling point below 200° C. and most preferably below 180° C.

In one feature of the present invention, in the second reactor a temperature is maintained in the range of 350 to 450° C. Preferably the temperature is maintained between 370 and 420° C. More preferably the temperature is maintained between 380 and 410° C.

In another feature of the present invention, in the second reactor a Linear Hourly Space Velocity (LHSV) is maintained in the range of 0.2 to 2.0. Preferably the LHSV is maintained between 0.2 and 1.5.

In yet another feature of the present invention in the second reactor a pressure is maintained in the range of 25 to 100 bar g. Preferably the pressure is maintained in the range of 35 to 90 bar g. More preferably, the pressure is maintained in the range of 50 to 75 bar g.

In one feature of the present invention, in the FCC reactor a temperature of the FCC riser is maintained in the range of 500 to 600° C. Preferably the temperature of the FCC riser is maintained between 520 and 580° C. In one of the features of the present invention, the FCC riser outlet temperature is 500° C.-550° C. for low severity and 550° C.-600° C. for high severity operation, while the catalyst oil ratios were 5-8 and 8-20 respectively.

In another feature of the present invention, in the FCC reactor a residence time is maintained in riser is in the range of 0.5 to 5.0 seconds. Preferably the residence time is maintained between 1.0 and 3.0 seconds.

In yet another feature of the present invention, all the catalyst used in the reactors are commercially available for hydro-treating, hydrocracking and FCC.

In one feature of the present invention, the LCO stream is the Middle distillate stream generated from the FCC/RFCC Unit and having boiling point in the range of 180-410° C. In another feature, the LCO stream is having aromatic content is in the range of 60 to 90 wt % and out of the total aromatic content, the concentration of mono-aromatic is in the range of 20-30 wt %, di-aromatic is in the range of 60-70 wt % and polycyclic aromatic is in the ranges of 10-20 wt %.

In one of the preferred features the LCO stream has a boiling range in between 140 and 390° C., more preferably between 180 and 410° C. and most preferably between 200 and 430° C.

In one of the feature of the present invention, it is observed that due to recycle of UCO in FCC, the concentration of aromatic molecules in the LCO is increased at least by 10 wt % more preferable by 7 wt % and most preferably 5 wt %, in which the concentration of di-aromatic is between 80-90 wt %. This increase in di-aromatic concentration in LCO further benefits the conversion in hydrocrocraking reactor to Alkyl benzene molecule. As a result of synergy, the overall yield of desirable alkyl benzene in cut-2 increases significantly.

DETAILED DESCRIPTION OF THE INVENTION

Figure 1:
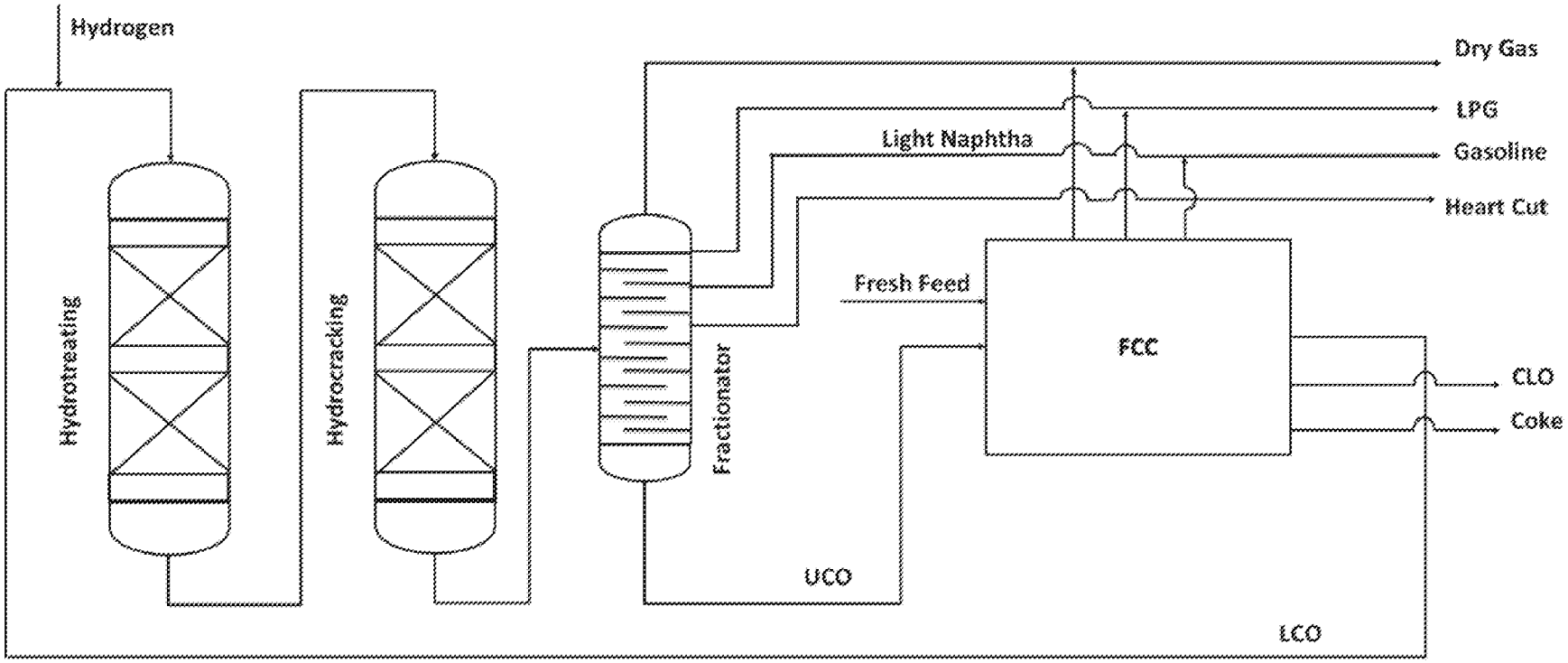
FIG. 1: Schematic of the process for the production of high aromatic naphtha and high octane gasoline from FCC and hydrocracking integration.
Figure 2:
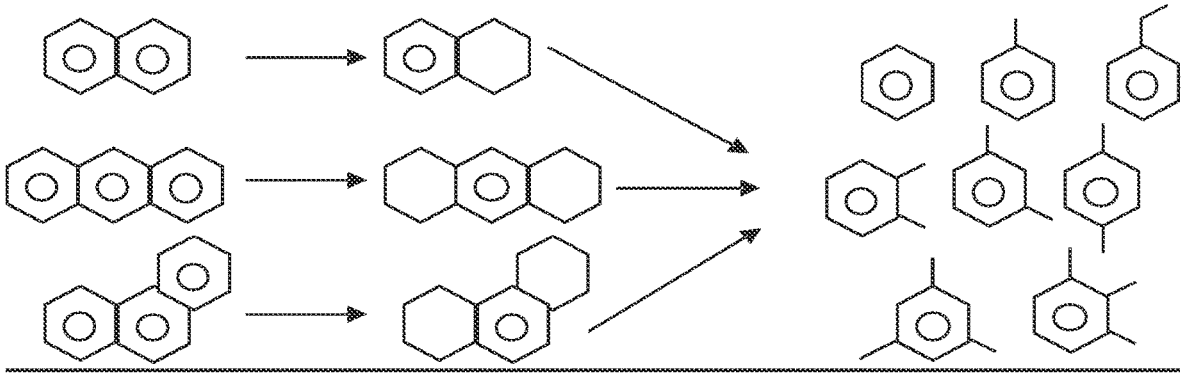
FIG. 2: Reaction Scheme for mild hydrocracking.
Figure 3:
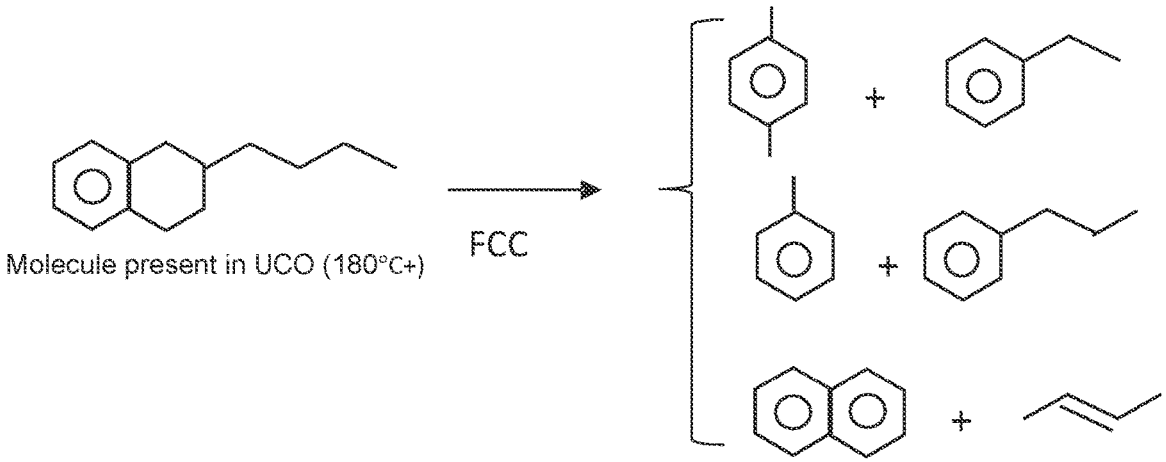
FIG. 3: Reaction Scheme for FCC.

While the invention is susceptible to various modifications and alternative forms, specific embodiment thereof will be described in detail below. It should be understood, however that it is not intended to limit the invention to the particular forms disclosed, but on the contrary, the invention is to cover all modifications, equivalents, and alternative falling within the scope of the invention as defined by the appended claims.

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention.

Accordingly, the present invention relates to a process for upgrading LCO to (i) high octane gasoline and high aromatic feedstock for aromatic complex, (ii) Utilization of FCC for cracking unconverted diesel range stream from hydrocracker to high octane gasoline. This invention discloses the process to improve the quality (e.g., RON, Sulfur) of gasoline by utilizing FCC and hydrocracking processes.

In one of the features of the present invention, LCO stream refers to the Middle distillate stream generated from the FCC/RFCC Unit. This stream preferably has a boiling range between 140 and 390° C., more preferably between 180 and 410° C. and most preferably between 200 and 430° C. This stream contains aromatic content ranges between 60 to 90 wt %. Out of the total aromatic content, the concentration of mono-aromatic ranges between 20-30 wt %; whereas the di-aromatics content ranges between 60-70 wt % and polycyclic aromatic ranges between 10-20 wt %. The properties of the LCO are given in Table 1. In the process for production of high octane gasoline and high aromatic feedstock, the di- & tri-ring aromatics are converted to alkybenzene types of molecules, suitable for production of BTX in the aromatic complex. Therefore, the LCO feed is used in the process as it is rich in aromatics, particularly, di- & tri-ring aromatics.

Light Naphtha (LN) refers to a hydrocarbon stream boiling range between C5 and 95° C., preferably between C5 and 75° C. most preferably C5 and 65° C. and called as 'high octane gasoline'. The Research Octane number (RON) of the stream is preferred between 80 and 95 units, more preferred between 85 and 92 units and most preferred between 88 and 91 units. This stream can be blended directly into the gasoline pool.

High aromatic feedstock or 'heart cut' refers to the naphtha stream generated from hydrocracker fractionator having a boiling range preferably between 95 and 210° C., more preferably between 85 and 200° C. and most preferably between 65 and 180° C. and called as 'high aromatic naphtha feedstock'. The aromatic content of this stream is preferably between 50 and 80 wt %, and most preferably between 60 and 75 wt %. This stream can be used in the aromatic complex as a feedstock. In case aromatic complex is not present in the refinery configuration, this stream can be used as blending stream for gasoline pool.

Unconverted Oil (UCO) refers to the diesel range stream generated in the hydrocracker fractionator having an initial boiling point (IBP) more than 210° C., preferable 200° C. and most preferably 180° C.

In another feature of the present invention, the process for the production of high octane gasoline and high aromatic naphtha feedstock for aromatic complex has the following steps.

a) LCO is subjected to hydro-treatment over any hydrotreating catalyst system known in the art. The hydrotreating reactor is a normal trickle bed plug flow reactor with down flow configuration as known in the common art of hydroprocessing. Hydrotreatment step is necessary to remove nitrogen, which has a detrimental effect on hydrocracking catalyst. Also, hydro-treatment selectively saturates one ring of the multi-ring aromatics molecules (di-aromatics and tri-aromatics) present in the feed.

b) The hydrotreated stream is subjected to a second reactor filled with hydrocracking catalyst. This reactor is also a trickle bed plug flow reactor with down flow configuration. In this step, cracking takes place in the saturated side ring of the molecules present in the hydro-treated stream. This particular ring opening reaction takes place in presence of specially designed hydrocracking catalyst, selective towards mono-aromatic maximization in mild operating condition. The properties of the hydrocracked product are given in Table-1.

c) The effluent from hydrocracker is then fractionated. Three cuts are generated. The yields of all three cuts are given in Table-3. Light Naphtha (high octane gasoline) is the lighter stream, taken out from the top of the fractionator. This stream contains significant amount of iso-paraffins and cyclo-paraffins. This stream has high RON value and also other properties matches with the properties of Ultra low sulphur gasoline (ULSG). Therefore, it can be directly blended in the gasoline pool. The second cut is the high aromatic naphtha feedstock. This stream is high in mono-aromatics and used as a feedstock for BTX production in the Aromatic Complex. In case of the absence of aromatic complex, this steam can also be blended to gasoline pool along with the high octane gasoline stream. The third cut is the unconverted cut and has a diesel boiling range. This cut has poor Cetane value. Also, density of this cut is high compared to the diesel stream. Therefore, this stream is further treated in the FCC Unit.

UCO is blended with Fresh feed and fed into the FCC unit. The blended feed is therefore cracked in the FCC environment and produces mono-aromatics along with paraffin/iso-paraffins. Some part of the UCO does not crack further in the FCC and gets concentrated in the clarified oil (CLO) stream of the FCC main fractionator. UCO produced from LCO hydrocracking contains 60-70 wt % of compounds which can be cracked into value added product in the FCC.

According to the other feature of the invention, UCO comprises 15-20 wt % of cyclo-paraffins, 15-20 wt % of alkyl benzenes and 25-30 wt % of benzo cycloparaffins (Table-2). These above mentioned molecules are highly reactive in the FCC environment and easily converted into mono-aromatics. The side chain/saturated ring attached to the benzene ring can be cracked into paraffins/isoparaffins and benzene ring remains unaffected in the FCC unit. The mono-aromatic molecule produced has a boiling point within gasoline boiling range. Therefore, yield of the high RON gasoline increases. For achieving optimum benefit from the proposed invention, the operating window of FCC and hydrocracker operation are optimized depending on the use of aromatic rich stream as blend component of gasoline or routing to Aromatic complex for production of BTX. LCO yield and quality from FCC unit depends on the unit severity, catalyst composition and riser outlet temperature (ROT) and with suitable combination, LCO of desired quality and quantity could be produced from FCC to further upgradation thru hydro-processing route. Similarly, for a particular quality of LCO, a suitable catalyst and hydroprocessing operating conditions could be set to achieve high RON gasoline and aromatic rich naphtha.

As can be seen from the Table-2, the UCO of low severity is having slightly higher naphthenes. The FCC operating conditions are controlled to maximize the yields from UCOs of low severity as well as high severity hydrocracking.

In yet another feature of invention, the UCO generated from LCO mild hydrocracking contains sulphur preferably less than 50 wt ppm, more preferably less than 20 wt ppm and most preferably less than 10 wt ppm. The UCO when subject to catalytic cracking in FCC unit generates gasoline with sulphur preferably less than 5 wt ppm, more preferably less than 1 wt ppm and most preferably less than 0.5 wt ppm. The fraction of UCO converted to LCO and CLO contains more sulphur compared to feed UCO, however lower than the LCO and CLO generated from 'fresh feed'. This low sulphur LCO and CLO further helps to reduce sulphur from gasoline generated due to cracking of 'fresh feed' by absorbing heavy sulphur species which generally ends up with gasoline fraction. This dual effect reduces sulphur in the gasoline generated from FCC.

In one of the feature of the present invention, it is observed that, due to recycle of UCO in FCC, the concentration of aromatic molecules in the LCO is increased at least by 10 wt %, more preferable by 7 wt % and most preferably 5 wt %, in which the concentration of di-aromatic is between 80-90 wt %. This increase in di-aromatic concentration in LCO further benefits the conversion in hydrocrocraking reactor to Alkyl benzene molecule. As a result of synergy, the overall yield of desirable alkyl benzene in cut-2 increases significantly.

In another feature of invention, the light naphtha generated in LCO hydrocracking process contains sulphur preferably less than 5 wt ppm and most preferably below 1 wt ppm when blended with FCC gasoline, reduce the sulphur without much disturbing the overall RON. The overall RON of the gasoline from this process complex is preferably between 90 and 94 unit and most preferably between 91-93 units.

In yet another feature of the invention, two product routing option has been conceptualized. Option-I: In this scenario, aromatic complex is present in the refinery. The Light Naphtha (high octane gasoline) stream is routed towards Gasoline pool owing to the fact that LN has high RON (~87) and low in Sulphur (i.e., <0.5 ppmw). The high aromatic naphtha feedstock is therefore used as a feedstock to the aromatic complex. The UCO stream recycled back into the FCC unit and cracked further to produce Gasoline. This gasoline has low sulfur content than the gasoline produced by 100% fresh feed processing.

In yet another feature of the invention, light alkenes (i.e., ethylene and propylene) is produced by cracking of alkyl chain attached with the benzene or naphthalene ring present in the UCO stream.

In yet another feature of the invention, the operating condition of the units. The hydro-treating reactor has been used to remove metals, heteroatoms (i.e., sulphur and nitrogen) and to saturate single aromatic ring of di-aromatics, tri-aromatics and PAH molecules. Nitrogen compounds have detrimental effect on hydrocracking catalyst and therefore must be maintained below 50 ppm, more preferably below 30 ppm and most preferably below 20 ppm. The reactor can be operated preferably between temperature range of 310 and 420° C., more preferably between 340 and 410° C. and most preferably between 350 and 390° C. The preferred pressure range of the reactor is between 25 to 100 bar g, more preferred is between 40 to 80 bar g and most preferred is between 50 to 75 bar. The Linear hourly Space Velocity (LHSV) is maintained between 0.5 and 1.5, most preferably is between 0.67 and 1.2.

In the hydrocracking reactor, the effluent from hydrotreating reactor is cracked and produces mono-aromatic, more specifically alkyl benzenes. In the conversion process, the saturated ring attached to benzene or naphthalene ring gets open producing alkyl benzene or alkyl substituted naphthobenzene. The molecules produced in this reactor has preferable boiling point below 200° C. and most preferably below 180° C.

The temperature in hydrocracking reactor is maintained between 350 and 450° C., more preferably between 370 and 420° C. and most preferably between 380 and 410° C. The Linear Hourly Space Velocity (LHSV) is maintained between 0.2 and 2.0 and most preferably between 0.2 and 1.5. The second reactor (R-2) pressure is also very critical. The preferred pressure for this process between 25 and 100 bar g and more preferred is between 35 and 90 bar and further most preferred is between 50 and 75 bar.

The temperature of the FCC riser is maintained preferably between 500 and 600° C. and most preferably between 520 and 580° C. The residence time maintained in riser is preferably between 0.5 and 5.0 seconds, most preferable between 1.0 and 3.0 seconds.

In yet another feature, all the catalyst used in the reactors are commercially available for hydro-treating, hydrocracking and FCC.

The following non-limiting examples illustrate in detail about the invention. However, they are, not intended to be limiting the scope of present invention in any way.

Example

LCO generated from FCC Unit is first hydrotreated and then hydrocracked. The properties of the LCO and hydrocracked product are given in Table-1. The hydrocracked product is then subjected to fractionation. The UCO generated from the fractionator as a bottom is then fed into FCC Unit. The properties of the UCO are given in Table-2. Two case studies have been conducted. In the 1$^{st}$ case hydrocracker is operated at high severity and in the 2$^{nd}$ case, the hydrocracked is operated at low severity. High severity is with respect to hydrocracking reaction. If UCO generation is low from the hydrocracking reaction that is refer to high severity. If UCO generation is high from hydrocracking step that is referred to low severity. In high severity, the aromatic content in UCO is more and vice versa. The hydrocracker yield for the cases is given in Table-3. The UCO generated from the bottom of the fractionator has been recycled back into the FCC Unit. The yield obtained from Recycle UCO feed is compared with the FCC operated with 100% fresh feed (Table-4).

TABLE 1

Properties of LCO and Hydrocracked LCO

| Properties | LCO | Hydrocracked LCO |
|---|---|---|
| Specific Gravity at 15° C., IS:1448-P:32 | 0.988 | 0.843 |
| Total Sulphur (ASTM D2622), ppmw | 4540 | 20 |
| Total Nitrogen (ASTM D4629), ppmw | 362.3 | 2.5 |
| Distillation, D- 2887, wt % | ° C. | ° C. |
| IBP | 114 | 16 |
| 5 | 202 | 26 |
| 10 | 218 | 48 |
| 30 | 252 | 99 |
| 50 | 274 | 129 |
| 70 | 304 | 166 |
| 90 | 348 | 245 |

TABLE 1-continued

Properties of LCO and Hydrocracked LCO

| Properties | LCO | Hydrocracked LCO |
|---|---|---|
| 95 | 367 | 283 |
| FBP | 425 | 365 |
| Cetane Number (D 7668) | <25 | — |
| Hydrocarbon classes by Mass Spectrometry analysis | wt % | wt % |
| Paraffins | 2.2 | 6.0 |
| Monocycloparaffins | 0.6 | 5.8 |
| Dicycloparaffins | 0.1 | 5.7 |
| Tricycloparaffins | 2.14 | 8.6 |
| Tetracycloparaffins | 1.1 | 0.0 |
| Pentacycloparaffins | 3.5 | 0.0 |
| Total Saturates | 9.64 | 26.1 |
| Alkylbenzenes | 5.2 | 31.0 |
| Benzocycloparaffins | 3.3 | 18.4 |
| Benzodicycloparaffins | 4.6 | 2.7 |
| Naphthalenes | 39.4 | 8.8 |
| Acenaphenes, biphenyls | 12.1 | 4.5 |
| Acenaphthylenes, fluorenes | 13.5 | 5.4 |
| Phenanthrenes | 3.2 | 1.6 |
| Pyrenes | 0 | 0.9 |
| Total Aromatics | 81.3 | 73.3 |
| Thiophenes | 0.3 | 0.0 |
| Benzothiophenes | 5.1 | 0.7 |
| Dibenzothiophenes | 0.6 | 0.0 |
| Naphthobenzothiophenes | 0 | 0 |
| Sulfur Compounds | 6 | 0.7 |

TABLE 2

Properties of the UCO

| Properties | UCO from High severity Hydrocracking | UCO from Low severity Hydrocracking |
|---|---|---|
| Specific Gravity at 15° C., IS:1448-P:32 | 0.918 | 0.991 |
| Total Sulphur (ASTM D2622), ppmw | 45 | 50 |
| Total Nitrogen (ASTM D4629), ppmw | 1 | 1 |
| Distillation, D- 2887, wt % | ° C. | ° C. |
| 5 | 198 | 200 |
| 10 | 200 | 204 |
| 30 | 220 | 224 |
| 50 | 239 | 240 |
| 70 | 268 | 269 |
| 90 | 325 | 319 |
| 95 | 352 | 344 |
| Cetane Index | 22.7 | 27.8 |
| Hydrocarbon classes by Mass Spectrometry analysis | wt % | wt % |
| Paraffins | 8.7 | 10.9 |
| Monocycloparaffins | 1.7 | 2.8 |
| Dicycloparaffins | 4.2 | 6.5 |
| Tricycloparaffins | 8.9 | 11.0 |
| Total Saturates | 23.5 | 31.2 |
| Alkylbenzenes | 15.2 | 17.9 |
| Benzocycloparaffins | 28.1 | 29.1 |
| Benzodicycloparaffins | 5.1 | 3.6 |
| Naphthalenes | 13.3 | 12.7 |
| Acenaphenes, biphenyls | 7.0 | 3.3 |
| Acenaphthylenes, fluorenes | 6.2 | 2.2 |
| Phenanthrenes | 0.8 | 0.0 |
| Pyrenes | 0.1 | 0.0 |
| Total Aromatics | 75.8 | 68.8 |
| Benzothiophenes | 0.8 | 0.0 |
| Sulfur Compounds | 0.8 | 0.0 |

TABLE 3

| Yield of the Hydrocracker | | |
|---|---|---|
| Case | High Severity Hydrocracking | Low Severity Hydrocracking |
| Dry Gas | 2.06 | 0.80 |
| LPG | 10.30 | 5.68 |
| High Octane Gasoline (C5-65° C.) | 14.02 | 6.40 |
| High Aromatic Naphtha Feedstock (65-200° C.) | 59.38 | 48.00 |
| UCO (200° C.+) | 14.24 | 39.12 |
| Total | 100.00 | 100.00 |

TABLE 4

| Comparative table for yield of the integrated process | | | |
|---|---|---|---|
| | | FCC with Fresh feed + Recycle UCO | |
| Case | FCC with 100% fresh feed Base | UCO of High Severity Hydrocracking | UCO of Low Severity Hydrocracking |
| Dry Das | 2.83 | 3.52 | 3.42 |
| Ethylene | 3.97 | 4.24 | 4.52 |
| LPG | 9.47 | 12.77 | 12.38 |
| Propylene | 11.98 | 12.15 | 12.96 |
| 1-Butene | 1.54 | 1.60 | 1.71 |
| iso-Butene | 2.3 | 2.37 | 2.52 |
| Gasoline (C5-198° C.) | 20.54 | 24.04 | 23.61 |
| High Aromatic Naphtha Feedstock (65-198° C.) | 0.00 | 14.84 | 12.76 |
| LCO (198-358° C.) | 22.27 | 0.00 | 0.00 |
| CLO (358° C.+) | 16.95 | 15.43 | 16.46 |
| Coke | 8.15 | 9.05 | 9.66 |
| Total | 100.00 | 100.00 | 100.00 |

The operating conditions of the FCC unit are optimized and controlled to maximize catalytic cracking of UCO. The FCC riser outlet temperature is preferably 500° C.-550° C. for low severity and 550° C.-600° C. for high severity operation, while the catalyst oil ratios were 5-8 and 8-20 respectively.

Advantages of the Present Invention

The following are the technical advantages of the present invention over the prior art as disclosed above:

High yield of Petrochemical feedstock generation from LCO at very low pressure. More particularly, the pressure (Hydrogen partial pressure) in convention unit is more than 100 bar g. However, in the present case (present invention) it is lower than 100 bar g, more preferably 70 bar g and most preferably, 50 bar g.

High gasoline yield can be obtained from FCC with high RON and low aromatics.

The invention claimed is:

1. A process for production of high octane gasoline and high aromatic feedstock, the process comprising:

(a) subjecting a light cycle oil (LCO) feed having a boiling point in a range of 180 to 410° C. to hydrotreatment in a first reactor to obtain a hydrotreated stream, wherein in the hydrotreated stream heteroatoms are removed and one or two rings of multi-ring aromatic molecules are selectively saturated, leaving at least one ring of the multi-ring aromatic molecules present in the feed unsaturated, wherein the multi-ring aromatic molecules comprise di-aromatics and tri-aromatics;

(b) subjecting the hydrotreated stream to hydrocracking in a second reactor filled with a catalyst for selectively opening a naphthenic ring attached to an aromatic ring present in the hydrotreated stream to obtain a hydrocracked stream;

(c) fractionating the hydrocracked stream into three cuts, wherein:

(i) a first cut is a light naphtha having a boiling point in a range of initial boiling point (IBP) to 95° C., (ii) a second cut is a high aromatic feedstock having an aromatic content in a range of 50 and 80 wt. % and a boiling point in a range of 95 to 210° C., wherein the second cut is rich in alkyl benzene, and (iii) a third cut is an unconverted oil (UCO) having an IBP initial boiling point more than 210° C.; wherein the UCO is rich in tetra-hydro-naphthalene or substituted tetra-hydro-naphthalene;

(d) cracking the third cut comprising the UCO in a fluid catalytic cracking (FCC) unit, wherein a temperature in a range of 500 to 600° C. is maintained in a FCC riser of the FCC unit, and wherein the UCO is blended with fresh feed and fed into the FCC unit to produce products comprising ethylene, propylene, light cracked naphtha (LCN), heavy cracked naphtha (HCN), LCO distillates, and clarified oil (CLO) distillates; and (e) feeding back the LCO distillates generated in the FCC unit to the step (a).

2. The process as claimed in claim 1, wherein the LCO generated in the FCC unit has 10 wt % higher aromatic content compared to the light cycle oil generated from fresh feed.

3. The process as claimed in claim 1, wherein LCO generated in the FCC unit has 10 wt % higher aromatic content than the light cycle oil generated from the fresh feed, and wherein the LCO has a di-aromatic concentration of at least 80 wt %.

4. The process as claimed in claim 3, wherein LCO generated in the FCC unit increases alkyl-benzene concentration in the second cut by 5 wt %.

5. The process as claimed in claim 1, wherein the UCO comprises 15-20 wt % of cyclo-paraffin, 15-20 wt % of alkyl benzene and 25-30 wt % of benzo-cyclo-paraffin.

6. The process as claimed in claim 1, wherein the hydrotreatment is carried out at a temperature in a range of 310 to 420° C.

7. The process as claimed in claim 1, wherein the hydrotreatment is carried out at a pressure in a range of 25 to 100 bar g.

8. The process as claimed in claim 1, wherein a Linear Hourly Space Velocity (LHSV) while hydrotreatment is maintained in a range of 0.5 to 1.5.

9. The process as claimed in claim 1, wherein the second reactor is maintained at a temperature in a range of 350 to 450° C.

10. The process as claimed in claim 1, wherein the second reactor is maintained at a Linear Hourly Space Velocity (LHSV) in a range of 0.2 to 2.0.

11. The process as claimed in claim 1, wherein the second reactor is maintained at a pressure in a range of 25 to 100 bar g.

12. The process as claimed in claim 1, wherein the riser of the FCC reactor is maintained at a residence time in a range of 0.5 to 5.0 seconds.

13. The process as claimed in claim 1, wherein the LCO stream has an aromatic content in a range of 60 to 90 wt % and out of the total aromatic content, the concentration of mono-aromatic is in a range of 20-30 wt %, di-aromatic is in a range of 60-70 wt % and polycyclic aromatic is in a range of 10-20 wt %.

* * * * *